US006086432A

United States Patent [19]

Frinker et al.

[11] Patent Number: 6,086,432

[45] Date of Patent: Jul. 11, 2000

[54] ELECTRICAL PLUG CONNECTION

[75] Inventors: Uwe Frinker, Wuppertal; Stephan Peter Dieudonnè, Herne; Peter Pszola, Bonn, all of Germany

[73] Assignee: Vorwerk & Co. Interholding GmbH, Wuppertal, Germany

[21] Appl. No.: 09/252,769

[22] Filed: Feb. 19, 1999

Related U.S. Application Data

[63] Continuation of application No. 08/765,897, filed as application No. PCT/EP95/02364, Jun. 19, 1995, Pat. No. 5,906,520.

[30] Foreign Application Priority Data

| | | | |
|---|---|---|---|
| Jun. 29, 1994 | [DE] | Germany | 44 22 437 |
| Sep. 21, 1994 | [DE] | Germany | 44 33 657 |
| Nov. 21, 1994 | [DE] | Germany | 44 41 303 |

[51] Int. Cl.[7] ..... H01R 13/33

[52] U.S. Cl. ..... 439/841

[58] Field of Search ..... 439/841, 263, 439/840

[56] References Cited

U.S. PATENT DOCUMENTS 3,074,046 1/1963 Sullivan .

4,632,496 12/1986 Williams .

FOREIGN PATENT DOCUMENTS 22277 11/1969 Austria .

0352967 1/1990 European Pat. Off. .

9318460 3/1995 Germany .

8601645 3/1986 WIPO .

*Primary Examiner*—Gary F. Paumen

*Attorney, Agent, or Firm*—Martin A. Farber

[57] ABSTRACT

The invention relates to an electric plug connection (1) with a plug holder (7) and a pin (3), especially a round-section pin (3), in which the plug holder (7) has a holding compartment in which is an axially compressible coil spring (2) having individual turns (5, 6) with the turns (5) largely having the same main diameter (dh). In order to reduce wear to the minimum even with frequent plug-in cycles and also not to increase the plugging force excessively, the invention proposes that the main diameter (dh) be larger than the outside diameter (d) of the pin (3) and that one or a few of the contact windings (6) have a smaller contact diameter than the main diameter (dh) and than the outside diameter (d) of the pin (3).

10 Claims, 8 Drawing Sheets

3
28
27
30
23
7
25
24
2
17
26
29
30'
v

ELECTRICAL PLUG CONNECTION

RELATED APPLICATION

This application is a continuation application of our co-pending application Ser. No. 08/765,897 filed Mar. 24, 1997 (PCT/EP95/02364 with international filing date Jun. 19, 1995), the entire disclosure of which is considered as being part of the disclosure of this continuation application and is hereby incorporated in its entirety herein by reference.

FIELD AND BACKGROUND OF THE INVENTION

The invention relates to an electrical plug connection with a plug receiver and a plug pin, especially a plug pin of round cross-section, the plug receiver having a receiving chamber and an axially compressible coil spring having individual turns being disposed in the receiving chamber.

A known electrical plug connection of this type has a contact piece axially displaceable in the receiving chamber and is located ahead of the coil spring in the direction of insertion. The plug pin enters into end face electrical contact with the contact piece in an insertion operation. It is further known to provide a tubular plug receiver, onto which, on an outer surface, a coil spring is pushed on, one turn of the coil spring penetrating secant-like into the interior of the plug receiver through an opening in the plug receiver. In an insertion operation, the plug pin is pressed against an inner surface of the plug receiver by the turn which extends secant-like, so that in this manner the desired electrical contact comes about.

Each of these known plug connections is unsatisfactory in different respects. In regard to the axially displaceable contact piece, an electrical contact between the contact piece and the plug pin is achieved only on a comparatively very small surface. There results, on account of the small, point-form contacting surface, relatively high wear on the contacting surfaces, because flashover and contact-breaking sparks form precisely in the region of these surfaces. In the version with the spring turn extending secant-like, relatively high friction is produced between the plug pin and the inner surface of the plug receiver. The wear is especially great in this case when insertion and withdrawal takes place under electrical load. The mechanical wear is greatly promoted by the formation of contact-breaking and flashover sparks in the contact region. Having regard to the above-described state of the art, it is seen as a technical problem for the invention to provide an electrical plug connection in which, on the one hand, there occurs the least possible wear even with frequent insertion cycles, while on the other hand, the plugging force does not become too high, all this with good and reliable electrical contact.

SUMMARY OF THE INVENTION

This technical problem is solved initially and basically by the invention in that the main diameter of the turns is greater than an outside diameter of the plug pin and that one or a few of the contact turns have a smaller contact diameter than the main diameter, which smaller contact diameter is also less than the outside diameter of the plug pin. According to the invention, an electrical plug connection is obtained directly by insertion of the plug pin into the coil spring. A reliable and reproducible contact is moreover obtained in this way in that there is provided a programmed tight location within the extent of the coil spring, by means of a tightly laid turn. On account of the specified geometrical conditions, the plug pin, on an insertion operation, slides reliably into this tighter turn, namely the contact turn, by virtue of which the electrical contact is provided reproducibly, in each case at this location.

Preferably, it is also provided that as a result of an interaction between such a contact turn and a front region of the plug pin, the further turns of the coil spring in a front region of the coil spring come into a contacting engagement against the pin. This arises, for example, when the front end of the plug pin is formed to taper conically or in the form of a dome. By interaction with the plug pin with the contact turn, coil spring is made to bend outwards. This results, furthermore, in the turns of the coil spring which are situated ahead of the contact turn in the direction of insertion engaging on one side against the plug. As a result, there is obtained, at a multiplicity of locations, a reliable electrical contact between the plug pin and the coil spring. An electrical plug connection such as this is preferably provided in a domestic appliance such as a vacuum cleaner or a food processor, in a vacuum cleaner, for example, for connection of an electric carpet brush having its own electrical drive. In respect of a case of practical application, reference is also made, for example, to the applicant's utility model application 93 18 460.3. The plug connection may be used both as a control contact and as a main current contact. The plug system according to the invention is also distinguished in that the plug pin entering into the spring does not encounter any appreciable frictional resistance up to entry of the tip of the pin into the narrowing of the spring, namely the contact turn or the contact turns. The initial electrical contact is made in the region of the closely-lying spring turns of the entry opening. When the contact turns are reached, the actual electrical contact begins. By the force building up between the spring and the tip of the plug pin at an off-center point of the spring, the spring is bent in buckling manner about this point.

Thus, spring turns overlapping the plug pin then engage on the surface of the plug pin and define in total a large contact surface. The low friction between the plug pin and the spring turns until the actual contact takes place, keeps the wear slight. The necessary contact pressure between the coil spring and the plug pin is achieved, on the one hand, axially, by the rest of the spring remaining between the contact winding and up to a rear end face and, on the other hand, radially, by buckling of the spring and engagement of the turns against the plug pin. The closely-lying contact turns at the entry opening attract, as first and last contact location, the flashover and contact-breaking sparks produced on insertion and withdrawal under electrical load and keep the actual contact region free of the burn-off traces resulting from this. The extent of the contact overlap, as it is provided in plug systems according to the state of the art, may be equated, in the plug system herein described, to the forward advance of the plug which is possible between the contact turn being reached and the blocked condition (rigidification) of the rest of the spring remaining between the contact turn and the rear end face of the receiving chamber. The typical mechanical characteristics of the coil spring and the constructional layout of the diameter of the receiving chamber, of the coil spring and of the spring entry region, permit an introduction of the round plug pin with a large angle error, and radial and axial misalignment. With appropriate choice of the spring material and correct dimensional matching of the spring contact system, the spring force of the coil spring and thereby the contact force are maintained, even under extreme climatic conditions, up to the end of the service life of the plug system.

The invention further proposes that the contact turn be disposed offset towards a rear region of the coil spring in the direction of insertion of the plug pin. For example, the contact turn is formed at least in the second third of the coil spring, preferably also in the second half of the coil spring. A different arrangement may however also be provided in the individual case, since the position of the contact turn within the extent of the coil spring is dependent on the free pin length, on the dimensionally least favourable tolerance chain between the tip of the plug pin and the contact turn, as well as on the construction of the contact chamber and the position of the contact member. The coil spring itself may consist, in usual manner, of a spring wire. A front end of the plug pin may be formed in different ways, for example, hemispherically shaped. Preferred is a slightly conical formation of the front end of the plug pin. The entire coil spring is inserted with a bias in suitable manner in the plug receiver or the receiving chamber. There is thus built up a contact pressure of the coil spring on a contact member, which contact member is for example inserted at a rear face, as further described in more detail below, so as to guarantee a reliable electrical contact for the outwardly-leading wire. When a plug pin is inserted, there may take place, as a function of the bias and of the insertion pressure, a lifting-off of the coil spring from the end face engagement surface of the entry opening of the receiving chamber. On the other hand, the coil spring, on withdrawal of the plug pin, does not lift off the end face engagement surface at the contact member. A wall of the receiving chamber, which is disposed to the side of the coil spring, extends preferably with a spacing relative to the coil spring which corresponds to at least about one diameter of a spring wire of which the coil spring is comprised.

An outside diameter of the coil spring is exceeded on both sides by at least 0.5 mm. This holds good, for example, for small pin diameters; however, the spring contact system may also be used with a different construction. By this, it is ensured that the coil spring may be displaced for a pin which is not centrally introduced, so as to avoid a too rapidly increasing, wear-promoting frictional force. A rear end of the coil spring is further preferably joined to a contact member, which, by passage through the receiving chamber in a radial direction, facilitates an electrical connection. Further, the contact member may also be introduced in the axial direction into the receiving chamber. In this embodiment, the receiving chamber is preferably formed to be open at the end. The inserted contact portion, for example the contact portion inserted into the receiving chamber from the rear, thus replaces the rear end face of the receiving chamber and offers the coil spring an engagement surface at the end of the spring. At the same time, there is achieved, by this, good contact between the coil spring and the contact portion. Further, the contact portion may be provided with a crimp connection, for direct crimping-on of a wire.

A further embodiment of the invention is distinguished in that the coil spring is a helical spring, which has a few turns whose diameter is larger than the outside diameter of the plug pin, and which has further turns having a smaller diameter than the outside diameter of the plug pin. In this embodiment, the coil spring is therefore formed to be completely funnel-like. Here also, there is produced a contact engagement between the plug pin and the turns whose diameter is the same as or smaller than an outside diameter of the plug pin, the contact engagement possibly extending over two or perhaps three turns. By a corresponding geometric layout of the coil spring and of the length of the plug pin, it is ensured that, on an insertion operation, the plug pin is inserted so far into the coil spring that the front end comes into contact, in the manner discussed, with the tighter turns, namely the contact turns. The helical spring is furthermore also preferably arranged to be radially displaceable in the plug receiver.

A further aspect of the invention relates to an embodiment in which the coil spring acts upon a contact piece in the form of a contact sleeve which is axially displaceable within the receiving chamber. The special construction of the contact piece is of significance. In this regard, the invention proposes that the contact sleeve has a receiving opening for the plug pin. Thus, not only does the end face of the plug pin engage against the contact sleeve in the contact condition, but the pin is partially introduced into the contact sleeve. Moreover, it is preferred for the receiving opening to have an entry funnel. Differences in the axial alignment of the contact sleeve and of the pin, on an insertion operation, may thus be advantageously compensated. A further particular advantage is also provided, in regard to the entry funnel, in that on withdrawal of the plug pin from the contact sleeve, a contact-breaking sparking first occurs in the region of the receiving funnel, this receiving funnel, on the other hand, however, not being responsible for the electrical contact. Possible wear phenomena on the entry funnel do not therefore impair the electrical efficacy of the contact.

In a further embodiment, it is provided that the receiving opening of the contact sleeve merges into a continuation bore in the contact sleeve, which continuation bore has a smaller diameter than the plug pin. This continuation bore is formed in suitable manner as a blind hole. Overall, this also leads, in preferred manner, to an embodiment in which a contact surface is provided in the contact sleeve as an annular surface for end-face contact with the plug pin. This contact surface, in a further preferred embodiment, is formed spherically curved. As for the rest, the receiving opening also has, preferably, a diameter slightly larger than is an outside diameter of an associated plug pin. By this means, a slightly crooked position of the plug pin is tolerable also in the contact condition. There is no change in the electrical contact with regard to the annular, preferably spherically-curved contact surface.

BRIEF DESCRIPTION OF THE DRAWINGS

With the above and other objects and advantages in view, the present invention will become more clearly understood in connection with the detailed description of preferred embodiments, when considered with the accompanying drawings of which.

DETAILED DESCRIPTION OF THE PREFERRED EMBODIMENTS

Figure 1:
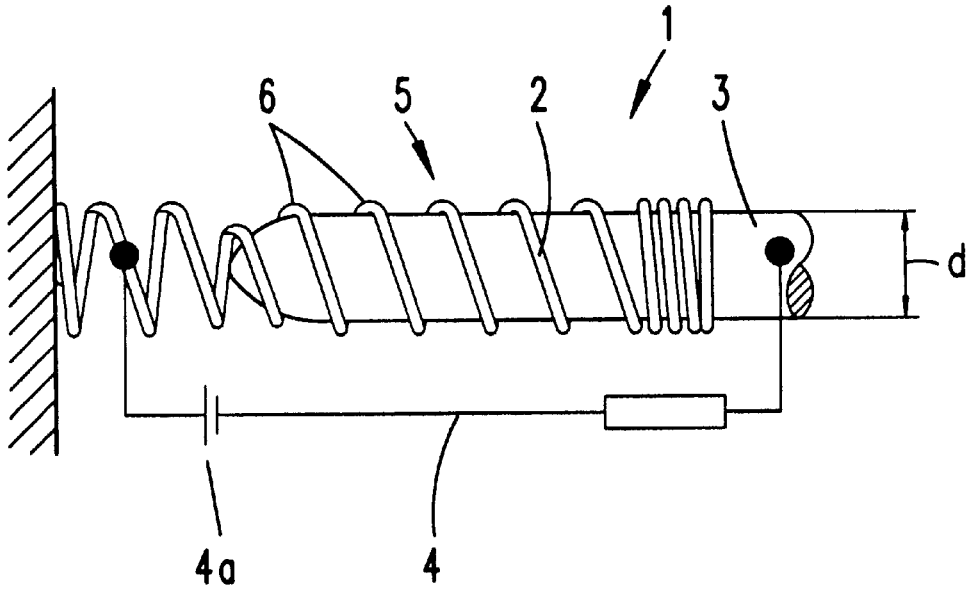
FIG. 1 shows a schematic representation of a plug pin with an electrical contact, introduced into a coil spring.

Represented and described, initially with reference to FIG. 1, is an electrical plug connection 1, which comprises a coil spring 2 and a plug pin 3. The coil spring 2 and the plug pin 3 are electrically conductive. By insertion of the plug pin 3 into the coil spring 2, an electrical circuit 4 may be closed.

Figure 2:
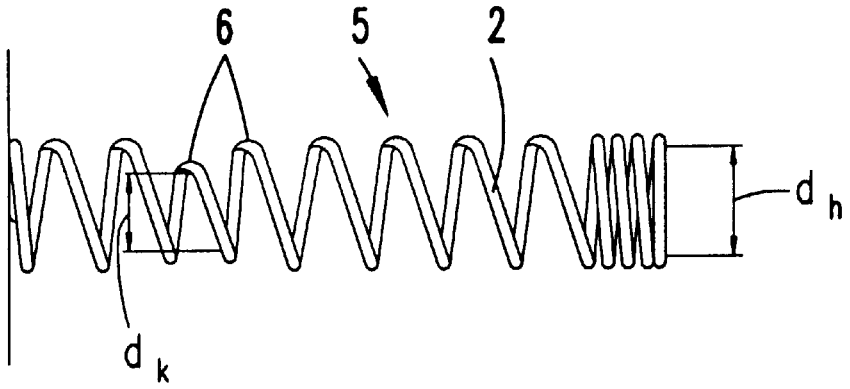
FIG. 2 shows the coil spring according to FIG. 1, in individual representation.

It is essential that the coil spring 2, as emerges in particular from FIG. 2, for the most part has turns 5 of an identical (inner) main diameter dh. Further, however, the coil spring 2 also has contact turns 6 which have a contact dimension dk less than the main diameter. The main diameter dh is larger by a small amount than an outside diameter d of the plug pin 3, while a contact diameter dk is smaller than the diameter d of the plug pin 3.

Figure 3:
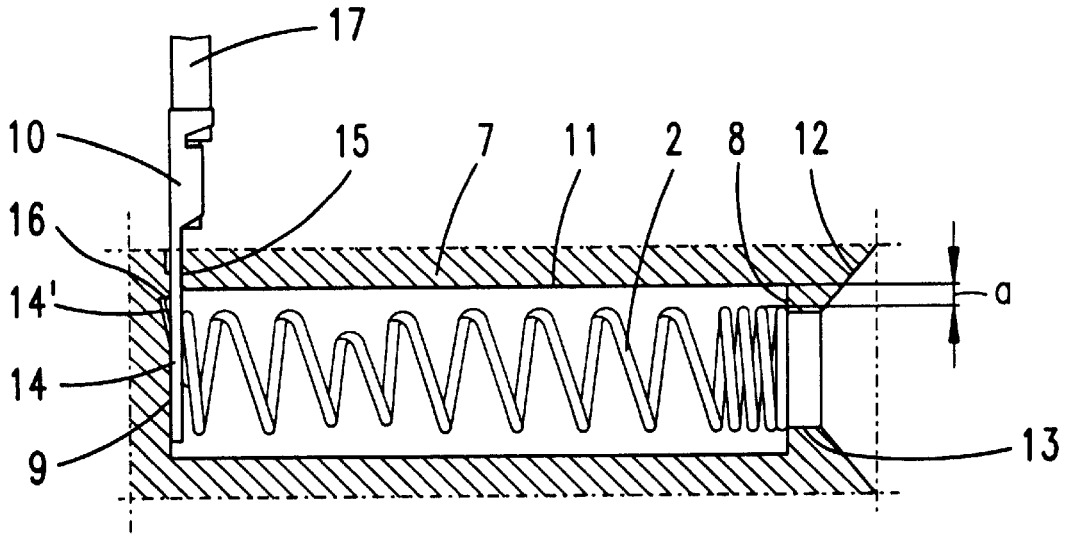
FIG. 3 shows the coil spring according to FIG. 2, accommodated in a receiving chamber.

As shown in FIG. 3, the coil spring 2 is disposed in a receiving chamber 7. The coil spring 2 is inserted into the receiving chamber 7 with bias, so that it engages with bias against, respectively, the front face 8 and the rear face 9 of the receiving chamber 7. The engagement on the rear face 9 may be effected by means of, or against, a contact member 10, which is described below in more detail.

Further, it is of importance that the coil spring 2 be inserted into the receiving chamber 7 in such a way that there results a radial free space a from a side wall 11 of the receiving chamber 7.

The receiving chamber 7 may, for example, be manufactured by the plastics injection moulding method—optionally in two portions for insertion of the coil spring 2. On the outer side, the receiving chamber 7 has, associated with a front end of the coil spring 2, an entry funnel 12, which leads into an entry opening 13. The entry opening 13 has approximately a diameter which corresponds to a main diameter dh of the turns 5.

Figure 4:
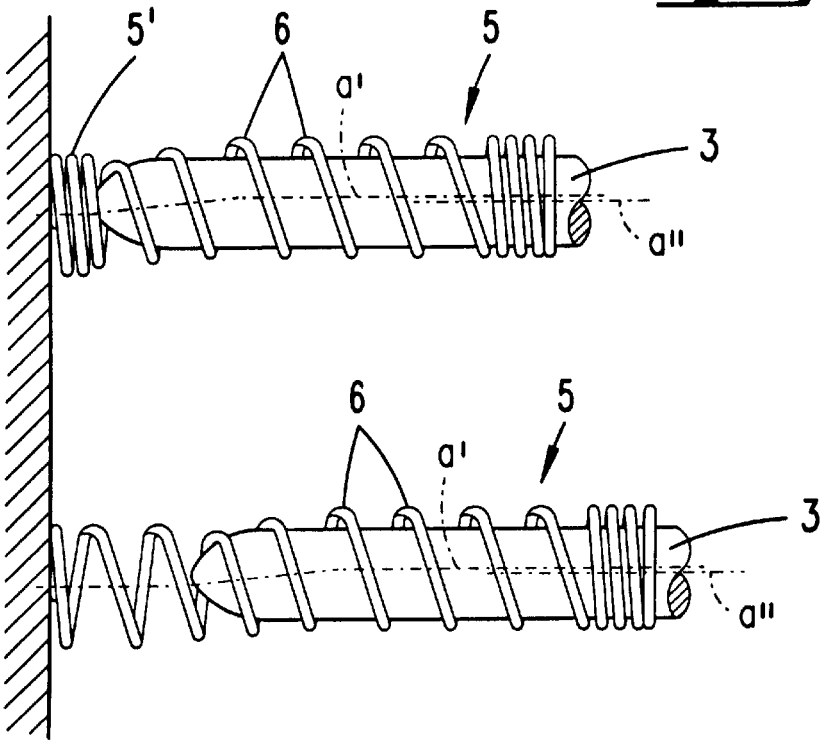
FIG. 4 shows a representation of an insertion operation of the plug pin into the coil spring.

In FIG. 4, there is made clear, in detail, the operation on inserting a plug pin into the coil spring and the resulting contact condition.

From the top representation, it is shown that the plug pin 3 is inserted so far into the coil spring that the coil spring compresses (somewhat), at any rate in the region of its free end turns 5'. On account of the geometry of the contact turns 6, there ensues, with plug pin 3 introduced according to FIG. 4, an offset between the longitudinal axis a" of the plug pin 3 and the center axis a' of the—unaffected —coil spring. On account of the given geometry, i.e. the dome-shaped formation of a tip of the plug pin 3 and the contact turns 6 naturally extending obliquely relative to the center axis a', there further results the fundamental effect that the coil spring 2 tries to bend outwards. However, this outward bending may take place only to a small extent, as a result of which the center axis a' of the coil spring 2 is displaced, and thereby also, a multiplicity of main turns 5, which overlap the plug pin 3, come to engage against the plug pin 3, on one side, in their lower region in the embodiment represented. Overall therefore, a multiplicity of turns, both the contact turns 6 and also the main turns 5, are in electrical contact with the plug pin 3. A very good contact is assured.

A conductive connection between the coil spring 2 and a voltage source 4*a* (see FIG. 1) of the electrical circuit 4 may be achieved, in particular, by the contact member 10 (see FIG. 3) already discussed. This contact member 10 has a contact surface 14 in the form of a small plate, the contact surface being inserted into the receiving chamber through a radial opening 15 in the receiving chamber 7. The contact member is located in front of the rear end wall 9 of the receiving chamber 7. The coil spring 2 is in compressive abutment against the small plate 14 at the front end of the spring. An expanded detent foot 14' of the contact member 10 may be inserted into a recess 16 of the receiving chamber 7.

Figure 5:
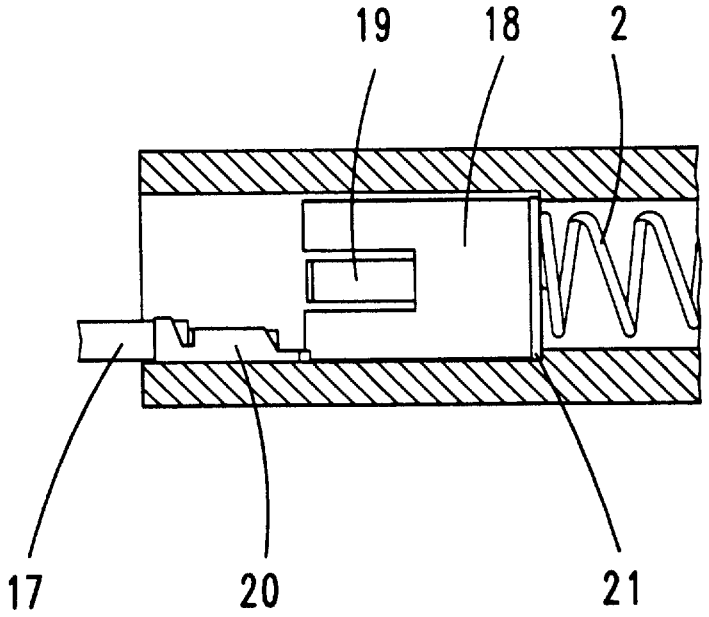
FIG. 5 shows a representation according to FIG. 3, with an alternative contact member.

In the embodiment of FIG. 5, there is alternatively provided a contact member 18 which has expanded detent feet 19, which are supported in corresponding recesses of the inner wall of the receiving chamber 7. By the bias of the coil spring 2, there is thus provided a secured position of the contact member 18. Additionally, a further assembly stop may be provided by the end face of a step 21 of the receiving chamber 7. Also connected to the contact member 18 is a crimp connecting point 20, in which a wire 17 may in like manner be crimp-connected. The contact member 18 is formed as a whole adapted, in its cross section, to the inner cross-section of the receiving chamber 7, thus, for example, circular.

Figure 6:
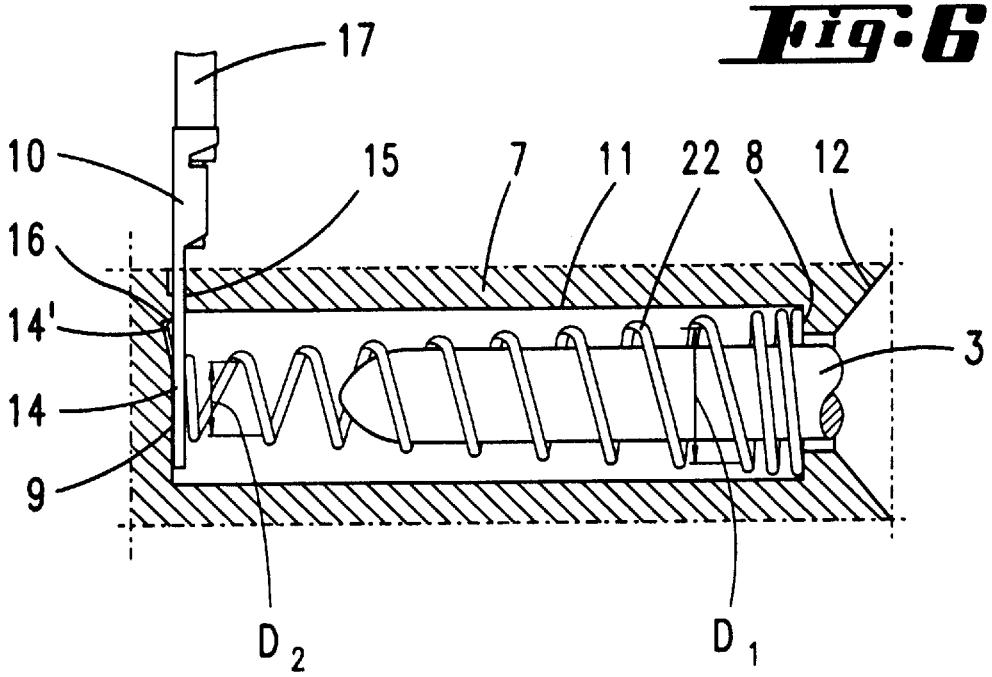
FIG. 6 shows an alternative embodiment of the subject matter according to FIG. 3.

In an embodiment of the electric plug connection according to FIG. 6, the coil spring is formed as a helical spring 22. The helical spring tapers from a largest diameter D1 at its beginning, to a smallest diameter D2 at its end. The plug pin 3 is introduced into the helical spring 22 in such a way that the larger diameters of the coils of the helical spring 22 do not engage against the plug pin 3, but that some of the smaller coils of lesser diameter do so engage.

The furthermore alternatively provided electrical plug connection according to FIGS. 7 to 13 consists initially, in corresponding manner, of a plug pin 3 and a receiving chamber 7 with a coil spring 2 located therein. In this embodiment, however, the coil spring 2 spring-loads its own contact sleeve 23. This contact sleeve comprises, in detail, an end portion 24 of larger cross-section which abuts against an end face 25 in the receiving chamber 7 under the bias of the coil spring 2. A front region of thinner cross-section is connected to this end portion 24, in one piece, in which region there is formed a receiving opening 26 for the plug pin 3. The entire contact sleeve 23, both the end portion 24 as well as the front region of thinner cross-section, is however accommodated in the receiving chamber 7. The receiving opening 26 has, at its front, an entry funnel 27. In the position represented in FIG. 7, in which the end portion 24 abuts against the end face 25, there is also produced a displacement v in relation to a front end face 28 of the receiving chamber 7.

A continuation bore in the form of a blind hole 30 of smaller diameter compared with the diameter of the receiving opening 26 is connected to the receiving opening 26 by means of a conically tapering contact surface 29. The blind hole 30 may, for example, accommodate particles of dirt developing.

Figures 7, 8, 9:
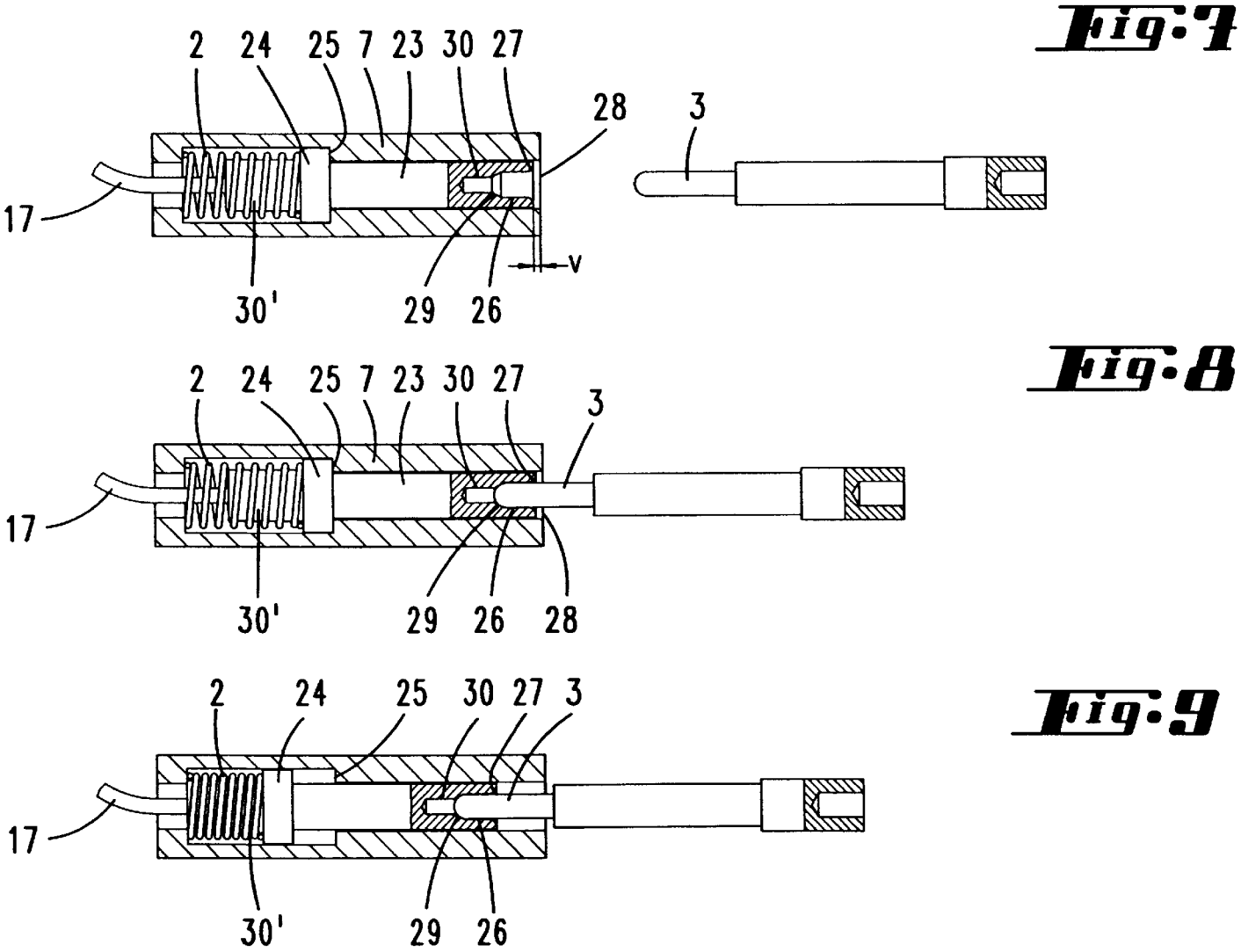
FIG. 7 shows a further alternative plug system.
FIG. 8 shows the plug system according to FIG. 7 on insertion of the plug pin.
FIG. 9 shows the plug system according to FIG. 7 and FIG. 8, with plug pin inserted.

FIGS. 8 and 9, disclose the movement operation on inserting the plug pin 3. Initially, the plug pin 3 is introduced into the receiving opening 26 and its end face thus then engages against the contact surface 29. The front end of the pin 3 may, as represented, be rounded, for example in the shape of a dome.

Furthermore, such a pressure is exerted on the plug pin 3 that the coil spring 2 is compressed and the contact sleeve 23 displaced, in the receiving chamber 7, towards a rear end.

As is further evident from FIGS. 7 and 8, a contact portion 30' of reduced diameter may be connected to the end portion 24, in further continuation, which contact portion is connected to a wire 17 in a manner known as such. The coil spring 2 is pushed over the contact portion 30'. It is not necessary, in this case, for there to be an electrical connection between the contact portion and the coil spring 2, because the coil spring 2, in this embodiment, has only a spring-loading function.

The plug pin 3 and the contact sleeve 23 are made of a material suitable for an electrical contact, for example, a bronze alloy.

In FIGS. 10 to 13, there is represented in detail, enlarged, the entry operation and the possible displacements of the pin.

Figure 10:
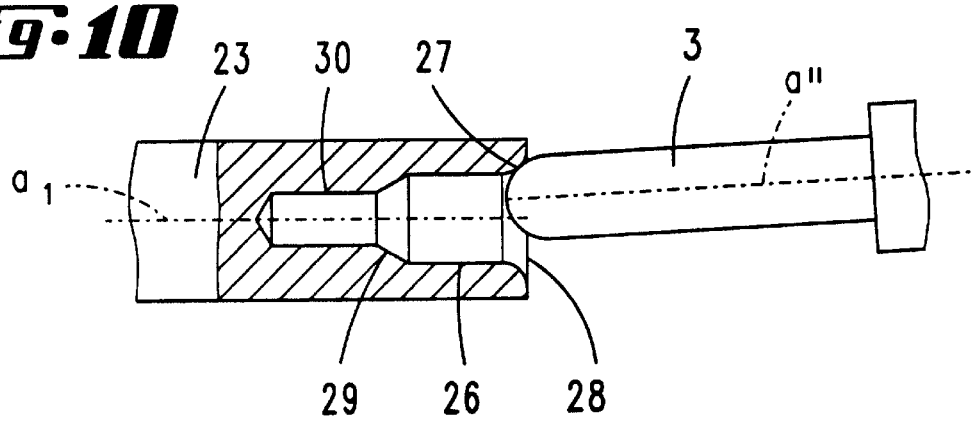
FIGS. 10 to 13 show a detail representation of the operations on insertion and withdrawal of a plug pin of the arrangement according to FIG. 7.
Figure 11:
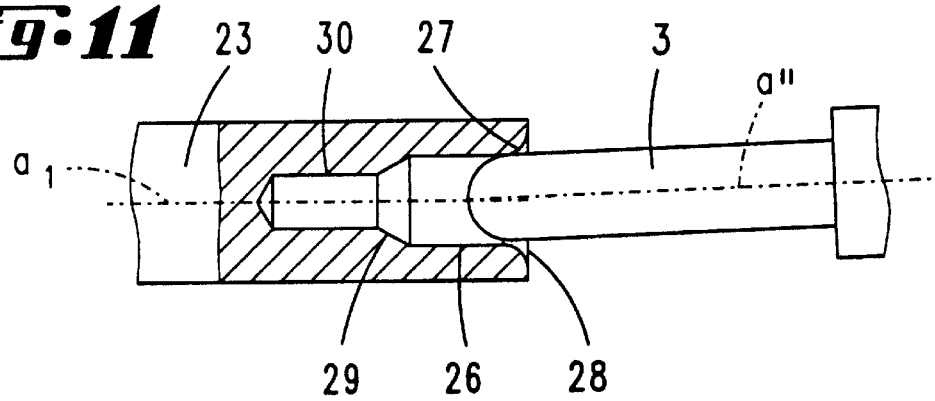
Figure 12:
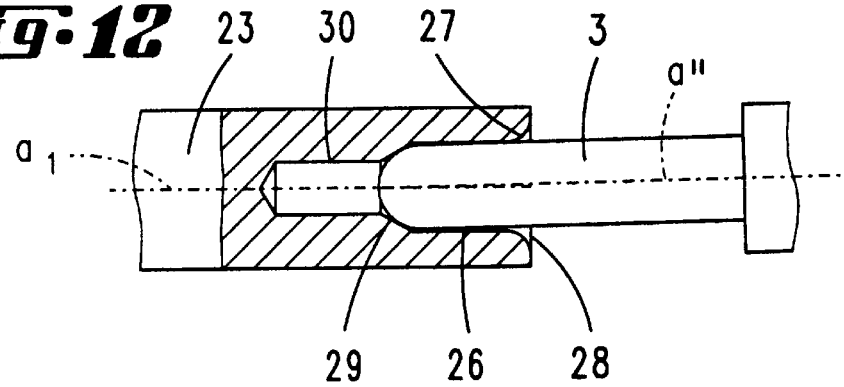
Figure 13:
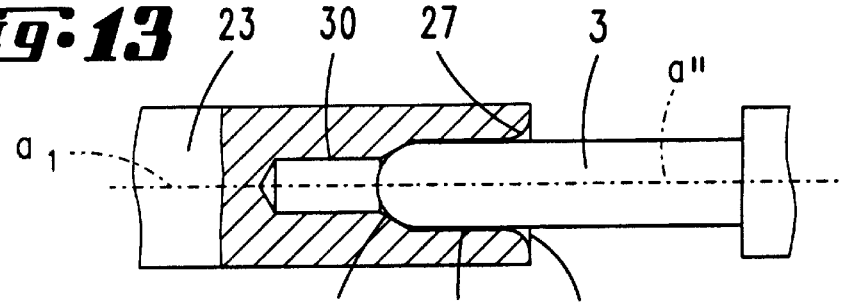

Initially, there is represented, in FIG. 10, a case in which a longitudinal axis a1 of the contact sleeve 23 does not align with a longitudinal axis a2 of the plug pin 3. On account of the entry funnel 27, there is produced however an entry effect, so that the plug pin 3 is diverted, according to FIG. 11, towards the center, i.e. towards the axis a1 of the receiving sleeve 23. In this regard, there may still be an angular offset between the axes a1 and a2, this being on account of the fact that a diameter of the receiving opening 26 is made a little larger than an outside diameter of the plug pin 3. In FIG. 13, there is represented a full alignment of the axes a1 and a2. It is essential that the location of origin of the contact-breaking sparking (entry funnel 27) be separated from the contact surface 29, i.e. axially distanced therefrom. With a conical formation of the contact surface 29, there is produced, in combination with a rounded tip of the pin 3, a linear contact zone. Overall, this type of electric plug connection represents a combination of end-face contact and circumferential contact (the latter by means of the side walls of the receiving opening 26). The insertion length of the plug connection is made up of an axial length of the receiving opening 26 and a spring travel of the coil spring 2. The spring travel is determinative of what is called a contact overlap. The described dimensional relationships facilitate a certain radial play of the plug pin 3 in the receiving opening 26. The friction, also produced by this, of the tip of the pin against the contact surface, has a positive effect in respect of a self-cleaning of the contact surfaces.

Figure 14:
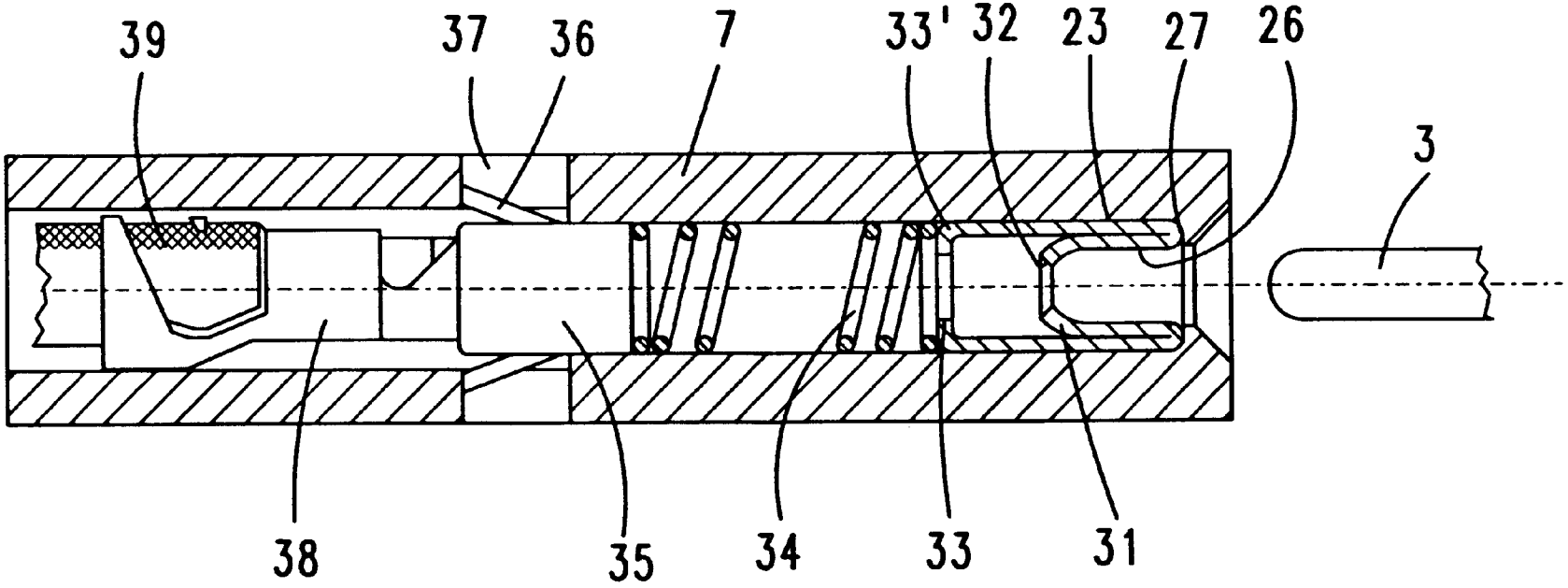
FIG. 14 shows a further cross-sectional representation of a receiving chamber with a contact sleeve located therein.

In the embodiment of FIG. 14, there is inserted into the receiving chamber 7, at the insertion-opening side, a contact sleeve 23 which has a receiving opening 26 for the plug pin 3. The receiving opening 26 is connected to an entry funnel 27 which, in the embodiment of FIG. 14, is formed by a bent edge or a flanged edge which is produced here. In detail, the contact sleeve 23, in the embodiment of FIG. 14, is made up geometrically of two tubular, integrally formed members of different diameter, the portion of smaller diameter being turned inwards, so that there is produced the above-mentioned bent or flanged edge. The contact sleeve 23 is however produced and formed as a whole in one piece by punching/bending. In further axial direction of insertion, the contact sleeve has an integrally-formed stop member 31, which has a central through-opening 32. This through-opening, in turn, is axially spaced apart from a further axial through-opening 33 in the larger cross-section portion of the contact sleeve 23. A base region 33' of the contact sleeve 23, formed by flanging, serves as abutment for a coil spring 34. At the opposite end, the coil spring 34 is supported on a detent portion 35, which, by means of radially diverging, barb-like formed detent feet 36, is supported in radial recesses 37 of the receiving chamber 7. An axial movement of the detent portion 35 in the direction of insertion of the plug pin 3 is not possible because of this. Connected to the detent portion 35, in one piece, is a crimp mounting 38 for attachment to a wire 39.

Corresponding substantially to the embodiments of FIGS. 7 to 9, the stop member 31 has an annular conical or spherically-curved surface, for end-face contact with the plug pin 3.

In this embodiment, as also in the embodiments of FIGS. 15 to 18 described below, it is, in particular, of significance that on account of the detent portion 35, no axial movement of the wire 39 can take place during the insertion operation. A simplification in regard to assembly is produced in that there is no need to thread a spring over the wire connection 38.

The coil spring 34 is of course formed to be electrically conductive.

Figure 15:
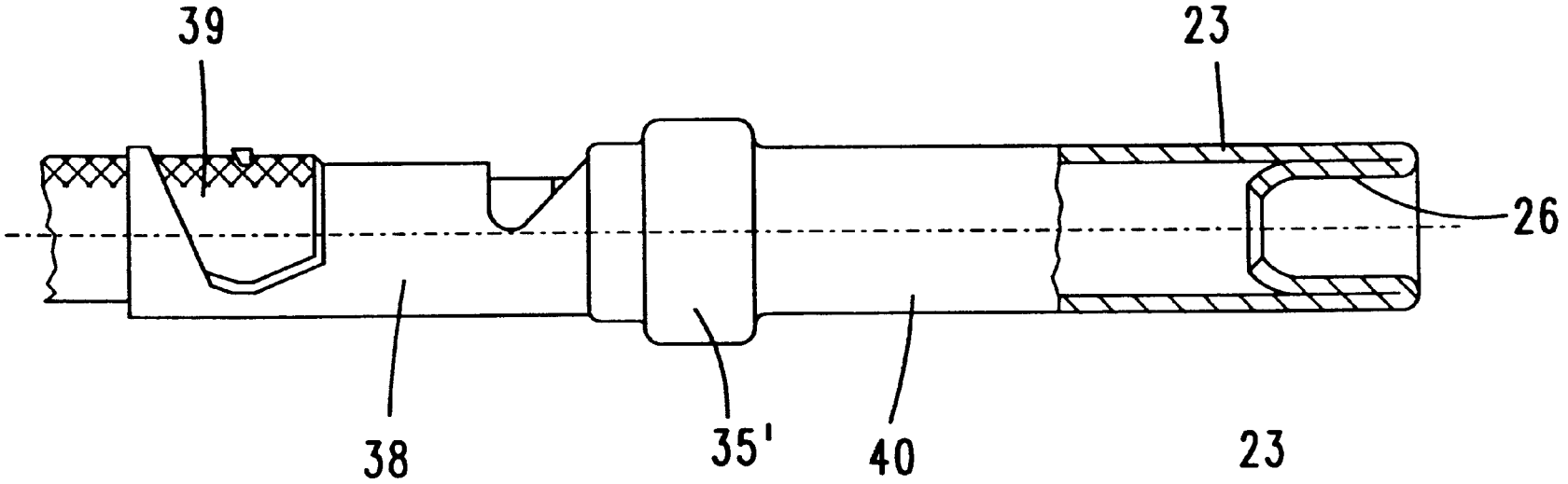
FIG. 15 shows a side view, partially in cross section, of a variant of the contact sleeve according to the arrangement of FIG. 14, with adjoining detent portion and wire connection portion.

In the embodiment of FIG. 15, the detent portion 35' is integrally formed by a radial widening. Also, the contact sleeve 23 is formed integrally with the detent portion 35' by means of a tubular connecting portion 40. Apart from that, it is to be taken from FIG. 15 that there the crimp connection 38 is linked, in direct connection, to the detent portion 35', as also already described above. It is furthermore of significance that the contact sleeve 23, in this embodiment, is not axially moveable.

Figure 16:
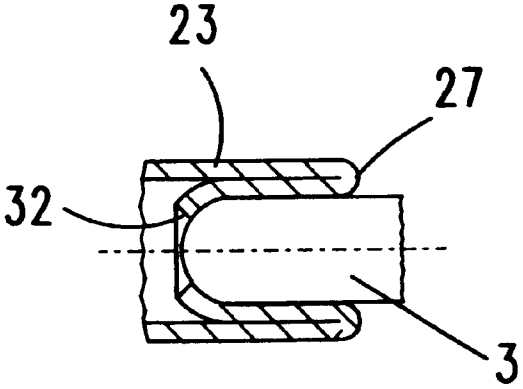
FIG. 16 shows a cross-sectional representation of a portion of the contact region of the contact sleeve with plug pin introduced.

From the cross-sectional representation of FIG. 16, there is to be taken, in detail, the favourable electrical contact in the stop member on account of the spherically-curved surface.

Figures 17, 18:
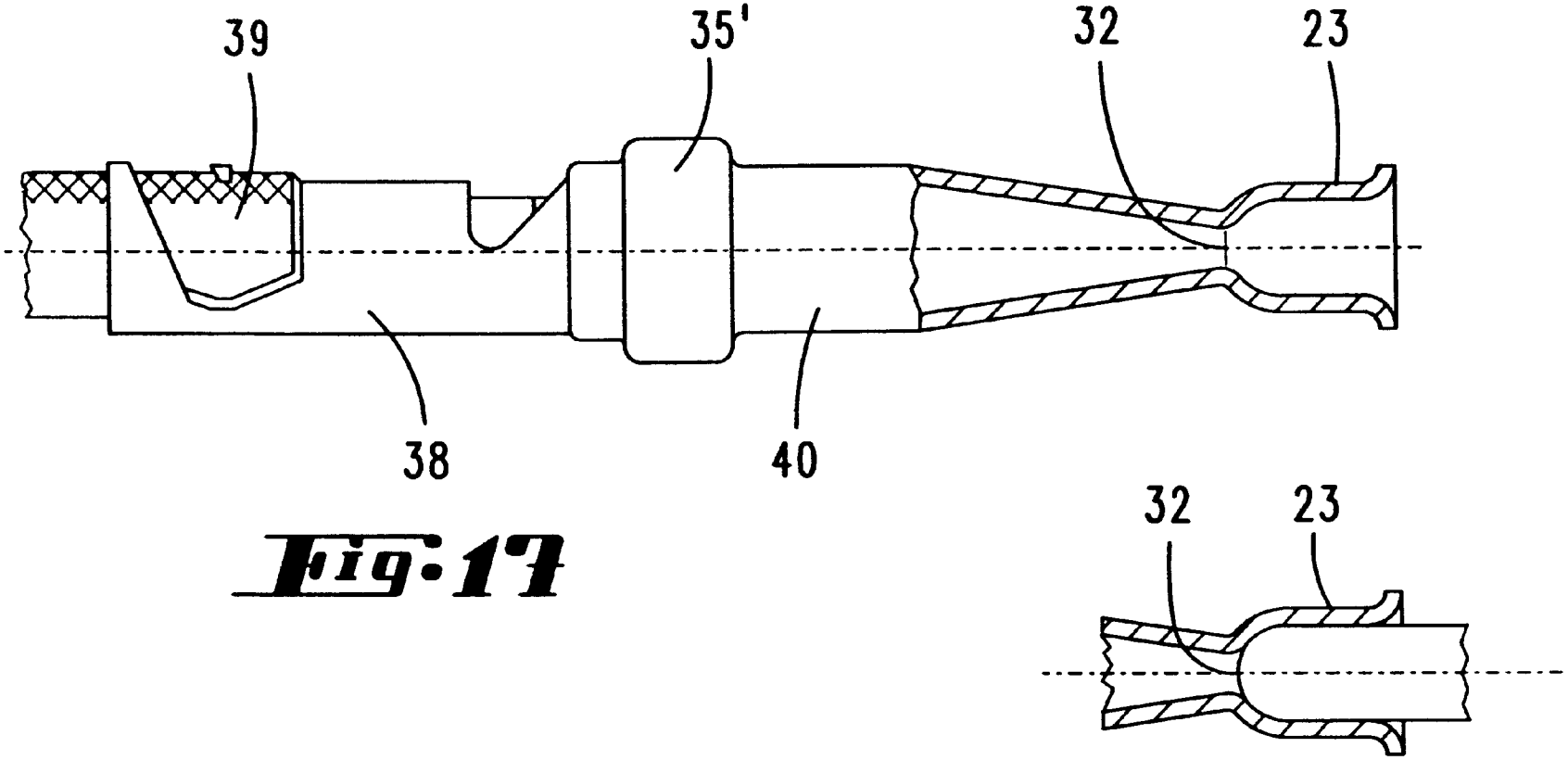
FIG. 17 shows a representation according to FIG. 15 of an alternative embodiment.
FIG. 18 shows a cross-sectional representation of a portion of the contact region of the alternative embodiment of FIG. 17, in a representation according to FIG. 16.

The embodiment of FIGS. 17 and 18 corresponds substantially to the embodiment of FIGS. 15 and 16, with the exception that the contact sleeve 23 no longer has a turned-in portion to form the spherically-curved stop surface, but instead the tubular connecting portion 40 tapers conically towards the contact sleeve 23 and merges, in the region of a smallest diameter, into the spherically-curved surface for end face contact with the plug pin 3. In this regard, there remains a through opening 32. From the cross-sectional representation of FIG. 18, it is to be taken that in this case also, there are produced substantially the same contact conditions as for the previously described embodiments of FIGS. 14 to 16.

We claim:

1. An electric plug connection comprising:

a plug pin and a plug receiver for receiving the plug pin, (said pin having a cylindrical wall terminating in a section of reduced diameter) said plug receiver comprising an axially compressible coil spring and a receiving chamber enclosing individual turns of the coil spring;

wherein at least one of the turns of said coil spring is a smaller diameter contact turn having a diameter smaller than a diameter of said plug pin for making contact with said pin upon insertion of said pin into said receiver;

wherein other ones of said turns of said spring are larger diameter turns having substantially equal diameters which are larger than a diameter of said pin in a case of non-insertion of said pin into said receiver; and larger diameter turns of said spring which are situated ahead of said at least one contact turn, in a direction of insertion of the pin, are axially spaced apart from each other, the longitudinal of said smaller diameter turn is displaced laterally from the longitudinal of said larger diameter turns prior to insertion of the plug pin thereby to improve contact between the pin and a larger diameter turn upon insertion of the pin into the smaller diameter turn.

2. An electric plug connection according to claim 1, wherein as a result of an interaction between a contact turn and a front region of said plug pin, said larger diameter turns in a front region of said coil spring come into contact engagement against said plug pin upon insertion of said pin into said receiver.

3. An electric plug connection according to claim 1, wherein a contact turn of said at least one contact turn is arranged offset, in the direction of insertion of said plug pin, towards a rear region of the coil spring.

4. An electric plug connection according to claim 1, wherein a front end of said plug pin is formed conically.

5. An electric plug connection according to claim 1, wherein said coil spring is biased in said receiving chamber.

6. An electric plug connection according to claim 1, wherein said coil spring engages only against an end face in said receiving chamber.

7. An electric plug connection according to claim 1, wherein a wall of the receiving chamber is spaced apart from said coil spring with a spacing of at least about one diameter of a spring wire of said coil spring.

8. An electric plug connection comprising:

a plug pin and a plug receiver for receiving the plug pin, said plug receiver comprising an axially compressible coil spring and a receiving chamber enclosing individual turns of the coil spring;

wherein said coil spring is a helical spring having a few turns with diameter larger than a diameter of said plug pin upon an insertion of said plug pin into said receiver; and further turns of said spring have a smaller diameter than the diameter of said pin, the longitudinal of said smaller diameter turns is displaced laterally from an axis of said larger diameter turns prior to insertion of the plug pin thereby to improve contact between the pin and a larger diameter turn upon insertion of the pin into a smaller diameter turn.

9. An electric plug connection according to claim 8, wherein said spring is radially deflectable in said plug receiver.

10. An electric plug connection comprising:

a plug pin and a plug receiver for receiving the plug pin, said plug receiver comprising an axially compressible coil spring and a receiving chamber enclosing individual turns of the coil spring;

wherein said coil spring is a helical spring having a few turns with diameter larger than a diameter of said plug pin upon an insertion of said plug pin into said receiver; and further turns of said spring have a smaller diameter than the diameter of said pin; and wherein said receiver has a contact member, and a rear end of said coil spring is joined to said contact member, said contact member passing through said receiving chamber in an axial direction thereof, to facilitate an electrical connection with the coil spring.

* * * * *